US008419125B2

(12) United States Patent
Quinn

(10) Patent No.: US 8,419,125 B2
(45) **Date of Patent: *Apr. 16, 2013**

(54) FOLDING CANOPY CHAIR

(75) Inventor: Thomas A. Quinn, Carlsbad, CA (US)

(73) Assignee: Pro Performance Sports, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/547,429

(22) Filed: Jul. 12, 2012

(65) Prior Publication Data

US 2012/0306242 A1 Dec. 6, 2012

Related U.S. Application Data

(63) Continuation of application No. 13/299,264, filed on Nov. 17, 2011, now Pat. No. 8,231,172, which is a continuation of application No. 12/704,696, filed on Feb. 12, 2010, now Pat. No. 8,091, 962.

(60) Provisional application No. 61/152,303, filed on Feb. 13, 2009.

(51) Int. Cl.
*A47C 7/66* (2006.01)
*A47C 4/28* (2006.01)

(52) U.S. Cl.
USPC ..... 297/184.16; 297/45

(58) Field of Classification Search ..... 297/45, 297/184.16
See application file for complete search history.

(56) References Cited

U.S. PATENT DOCUMENTS

| | | | |
|---|---|---|---|
| 3,050,280 | A | 8/1962 | Malachy |
| 3,848,838 | A | 11/1974 | Thomas |
| 4,318,567 | A | 3/1982 | Guthier |
| 4,470,630 | A | 9/1984 | Shields |
| 4,789,200 | A | 12/1988 | Munguia |
| 4,809,724 | A | 3/1989 | Fuser |
| 4,871,141 | A | 10/1989 | Chen |
| 5,110,184 | A | 5/1992 | Stein et al. |
| D338,327 | S | 8/1993 | Lewis |

(Continued)

FOREIGN PATENT DOCUMENTS

| | | | |
|---|---|---|---|
| DE | 202007013023 | U1 | 12/2007 |
| FR | 1601691 | A | 9/1970 |
| JP | 2006081916 | A | 3/2006 |
| WO | 199944458 | A1 | 9/1999 |

OTHER PUBLICATIONS

"Kelysus Convertible Canopy Chair," product sheet printed from http://www.amazon.com/Kelysus-Convertible-Canopy-Chair-Blue/dp/B00108LLKO/ref=p... (Feb. 11, 2009). 2 pages.

(Continued)

*Primary Examiner* — Rodney B White
(74) *Attorney, Agent, or Firm* — Kenneth H. Ohriner; Perkins Coie LLP

(57) ABSTRACT

A folding canopy chair includes a frame, a seat, a back, and arm rests. An umbrella is secured to the frame and is pivotal between an upright use position extending above the chair and a downward storage position adjacent the frame. The umbrella is pivotal about both a horizontal axis and a vertical axis for selective positioning of the umbrella relative to the chair, so as to shade a person sitting in the chair from the sun. The umbrella may be non-symmetrical, and removably mounted on either the left or right side of the chair.

9 Claims, 10 Drawing Sheets

U.S. PATENT DOCUMENTS

| | | | |
|---|---|---|---|
| 5,255,954 | A | 10/1993 | Rogers |
| D345,856 | S | 4/1994 | Johnson |
| 5,350,215 | A | 9/1994 | DeMars |
| 5,505,221 | A | 4/1996 | Gao |
| 5,873,624 | A | 2/1999 | Simpson |
| 5,873,625 | A | 2/1999 | Uchtman |
| D419,759 | S | 2/2000 | Goudarzi |
| 6,328,047 | B1 | 12/2001 | Lee |
| 6,439,659 | B1 | 8/2002 | Neubauer |
| 6,471,289 | B2 | 10/2002 | Aquilar |
| 6,520,574 | B1 | 2/2003 | Huang |
| D475,524 | S | 6/2003 | Clarke |
| D477,906 | S | 8/2003 | Martin |
| 6,666,221 | B1 | 12/2003 | Booth |
| D486,310 | S | 2/2004 | Goldy |
| D491,348 | S | 6/2004 | Clarke |
| D491,720 | S | 6/2004 | Clarke |
| D494,769 | S | 8/2004 | Vigneaud |
| 6,899,388 | B1 | 5/2005 | Enrique |
| 6,926,355 | B2 | 8/2005 | LeGette et al. |
| D516,296 | S | 3/2006 | Napieraj |
| 7,047,992 | B1 | 5/2006 | Fluellen |
| 7,201,442 | B1 | 4/2007 | Decosta |
| 7,226,126 | B1 | 6/2007 | Spanovich |
| D571,111 | S | 6/2008 | Louis-Jean |
| 7,395,828 | B1 | 7/2008 | Pulley |
| 7,431,389 | B2 | 10/2008 | Reeb et al. |
| 7,540,561 | B2 | 6/2009 | McWhorter |
| 7,562,930 | B1 | 7/2009 | Rondeau |
| D612,624 | S | 3/2010 | Lovley et al. |
| 8,091,962 | B2 | 1/2012 | Quinn |
| 8,231,172 | B2 * | 7/2012 | Quinn ..... 297/184.16 |
| 2002/0125748 | A1 | 9/2002 | Aguilar |
| 2002/0157693 | A1 | 10/2002 | Whitmer |
| 2004/0222678 | A1 | 11/2004 | Hansen |
| 2007/0236058 | A1 | 10/2007 | Yeider |
| 2008/0149152 | A1 | 6/2008 | Huang |

OTHER PUBLICATIONS

"UV Canopy for Kelsyus Chairs," product sheet printed from http://www.beachstore.conn/Beach-Products/BackPack-Beach-Chairs/UV-Canopy-for-Kels... (Feb. 11, 2009). 1 page.

"Renetto, The Original Canopy Chair" product sheet printed from http://www.canopychair.con/sitemap.html (Feb. 11, 2009). 1 page.

Written Opinion of the International Searching Authority in PCT Application No. US2010/024024.

European Patent Office, Extended European Search Report for EP10741769, Dec. 13, 2012.

* cited by examiner

FOLDING CANOPY CHAIR

CROSS-REFERENCE TO RELATED APPLICATIONS

This application is a continuation of U.S. patent application Ser. No. 13/299,264, filed Nov. 17, 2011 and now pending, which is a continuation of U.S. patent application Ser. No. 12/704,696, filed Feb. 12, 2010 and now U.S. Pat. No. 8,091,962, which claims the benefit of U.S. Provisional Application No. 61/152,303, filed Feb. 13, 2009, all of which are incorporated herein by reference.

BACKGROUND OF THE INVENTION

Folding chairs having a collapsible frame with fabric materials attached to the frame to form the chair seat and back rest are popular for outdoor activities and events. These chairs fold along perpendicular lateral and longitudinal axes, so as to be compact and fit easily into a sleeve-type bag for carrying and storage.

Canopies of various types are known for attachment to numerous types of folding chairs. These prior art canopies are generally symmetrical in shape and typically are mounted to the back of the chair using a pair of support arms on opposite sides of the chair frame, or using a single centered arm or post, such as for an umbrella attachment. These canopies and umbrellas sometimes limit the fold-ability of the chair, or must be removed before the chair is folded. Some canopies or umbrellas are removably or detachably mounted to the frame. These various prior art coverings often provide little adjustability of the canopy or umbrella over the chair to protect the person from the sun or rain. Therefore, a objective of the present invention is to provide an improved folding canopy chair having an adjustable umbrella.

SUMMARY OF THE INVENTION

The folding canopy chair of the present invention has a detachable canopy or umbrella which can be mounted to either side of the chair. The post of the umbrella may have two push button hinges for pivotal movement about two horizontal axes, while the umbrella top pivots 360 degrees about the post axis, to allow the position of the umbrella over the chair to be adjusted to protect a person sitting in the chair from the sun and/or rain.

DETAILED DESCRIPTION OF THE PREFERRED EMBODIMENTS

Figure 1:
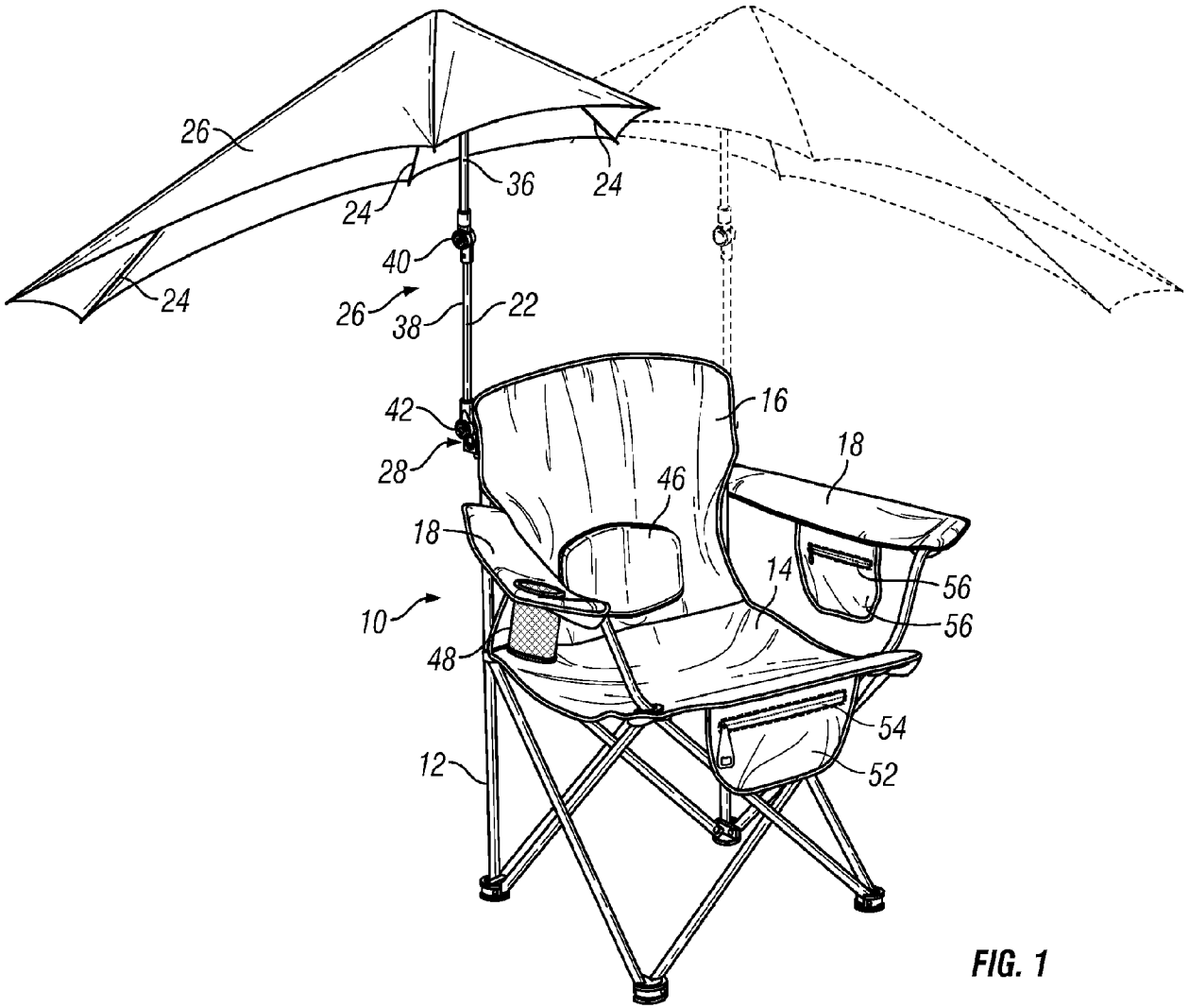
FIG. 1 is a perspective view of the improved folding canopy chair of the present invention, showing the umbrella in alternative positions on the left and right sides of the chair.
Figure 2:
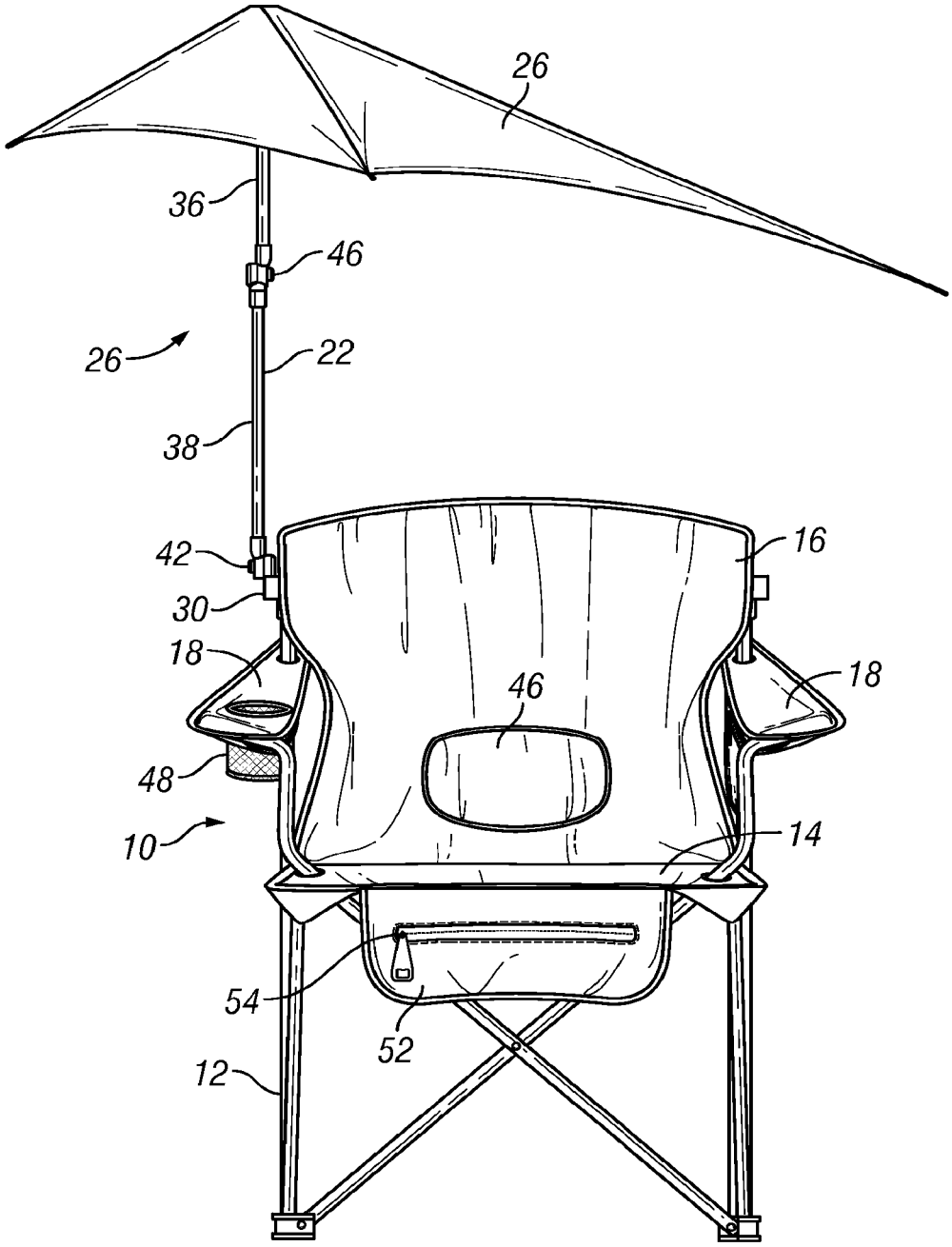
FIG. 2 is a front elevation view of the canopy chair.
Figure 3:
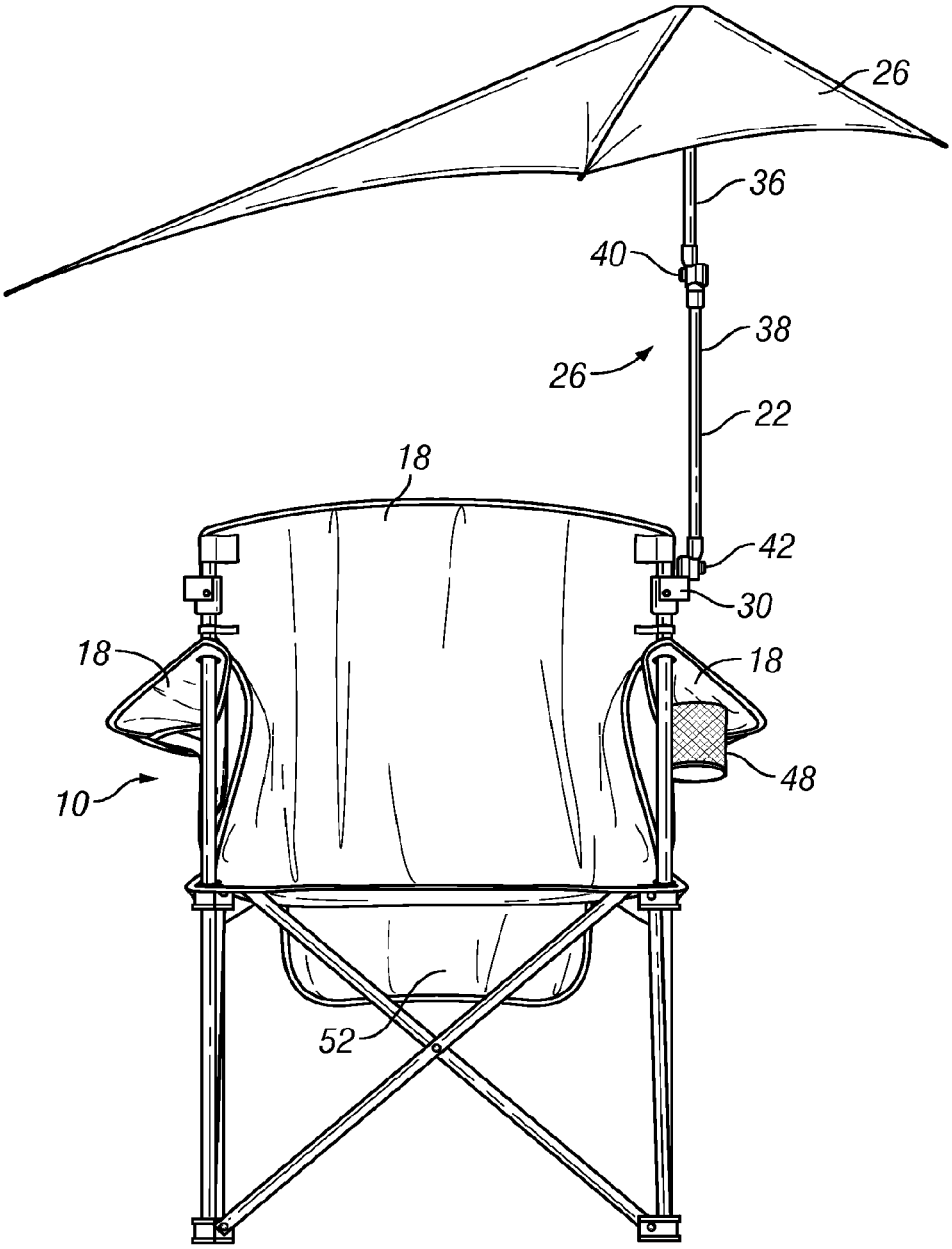
FIG. 3 is a left side elevation view of the canopy chair.
Figure 4:
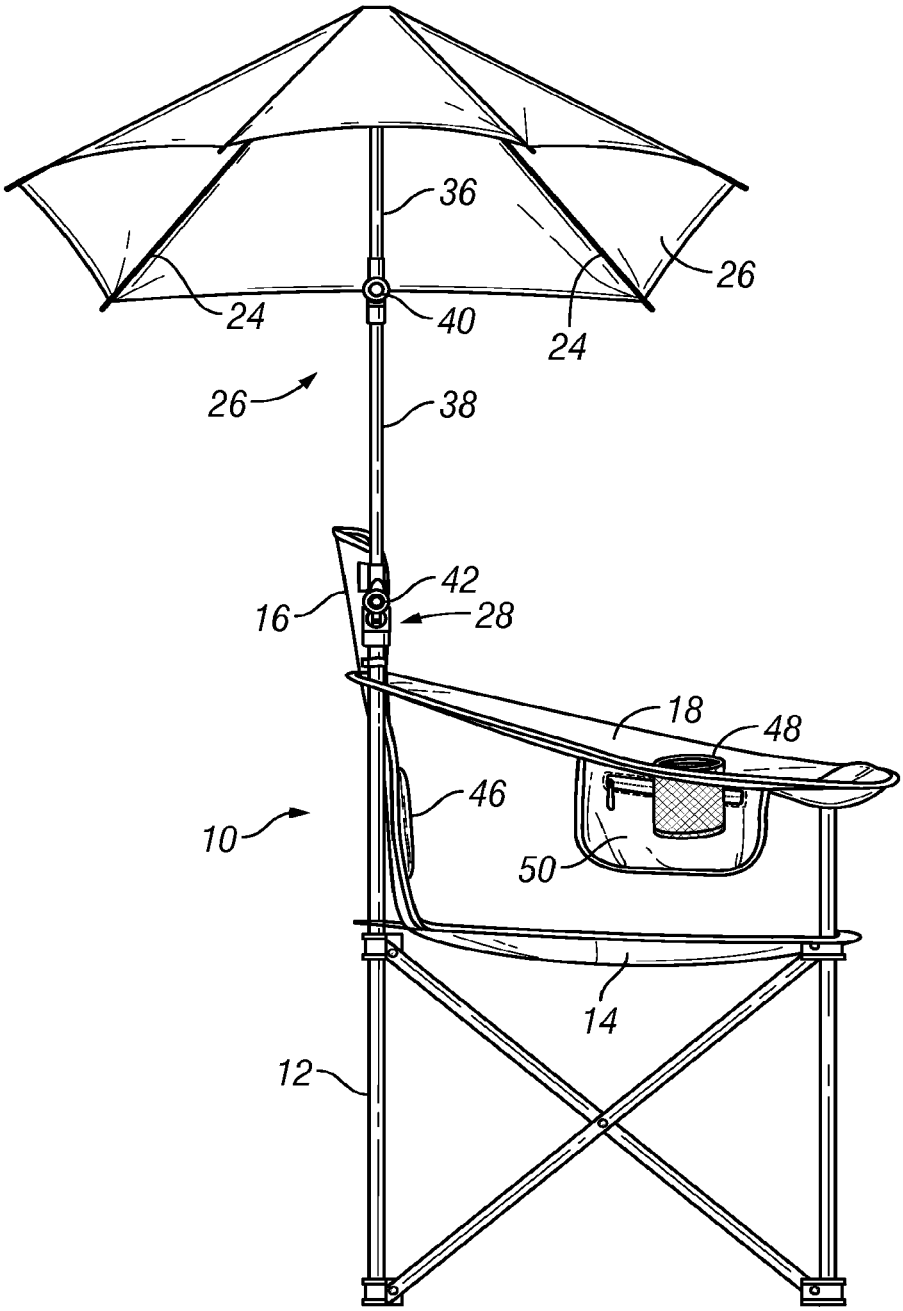
FIG. 4 is a right side elevation view of the canopy chair.

A chair is generally designated in the drawings by the reference numeral 10. The chair includes a folding frame 12 which forms the legs of the chair and the supports for the back rest, seat, and arm rests of the chair 10. Fabric material is attached to the frame 12 so as to form the chair seat 14, back rest 16, and arm rests 18. The chair 10 can be folded and unfolded between a use position and a storage position. The general construction of the frame 12, seat 14, back rest 16 and arm rests 18 may take various forms known in the art, such as the commercially available "Kelsyus" chair.

The chair 10 includes a canopy 20 removably connected to the frame 12. The canopy 20 is in the form of an umbrella, with a post 22, a plurality of spokes 24, and a fabric covering or body 26.

The lower end of the post 22 is mounted to the frame 12 using a clip 28. The clip 28 may take any convenient form. In a preferred form, the clip 28 includes a female receptacle 30 fixed to an upper side of the frame 12 adjacent the back rest 16 of the chair 10. The lower end of the post 22 includes a male member 32 with a resilient tab 34 received in the female receptacle 30 so as to lock the canopy 20 to the frame 12. The receptacle 30 has an opening so that a person's finger can depress the tab 34 to unclip the umbrella 20 from the chair 10. The resilient tab 34 allows the canopy 20 to be removed from the female receptacle 30. As shown in the drawings, a receptacle 30 is provided on both the left and right sides of the frame 12, such that the canopy 22 can be selectively positioned in either side of the chair 10, as desired by a person sitting in the chair.

In the preferred embodiment, the post 22 of the canopy 20 has upper and lower segments 36, 38. A push button hinge 40 is provided at the juncture of the upper and lower segments 36, 38, to allow the upper segment 36 to pivot forwardly and rearwardly approximately 180°-270° about a horizontal axis relative to the lower segment 38. A second push button hinge 42 is provided at the bottom of the lower segment 38, adjacent the male clip member 32, which allows the lower segment to pivot forwardly and rearwardly at least 270° between the arm rests of the chair 10 and the back corner of the frame 12.

Figure 5:
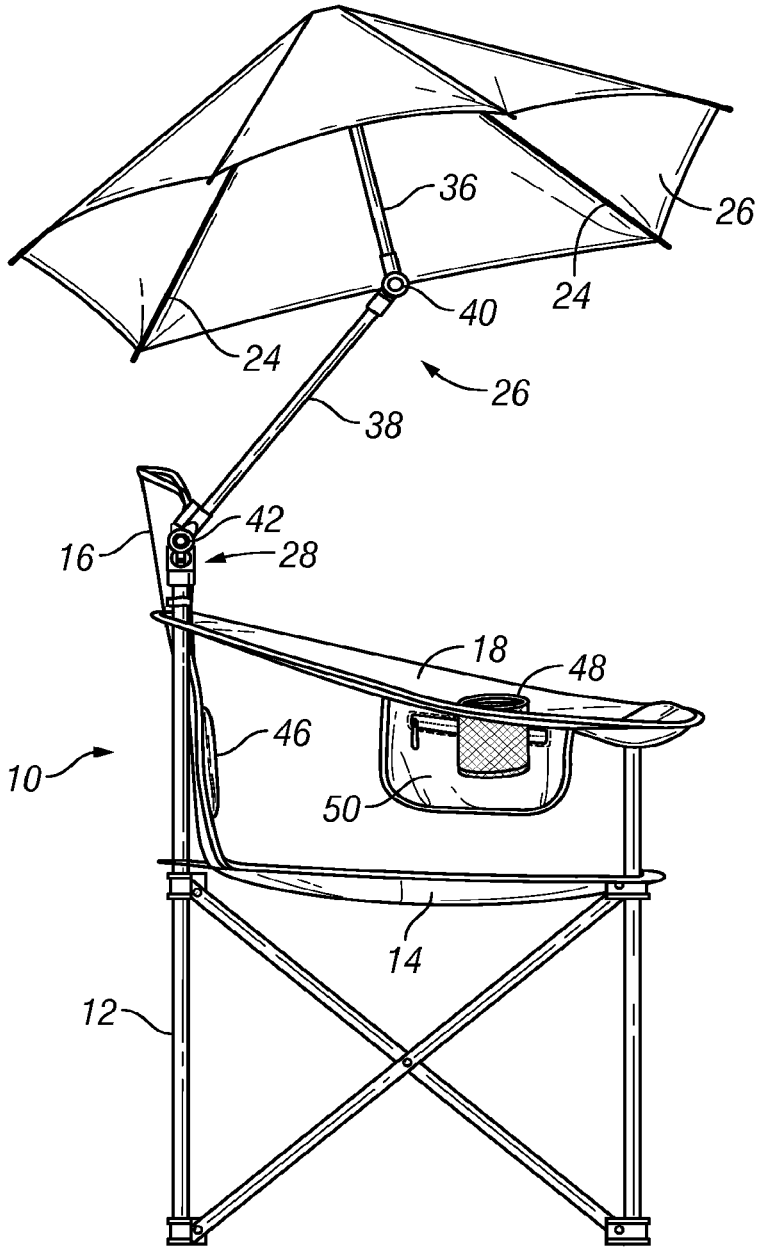
FIG. 5 is a view similar to FIG. 4 showing one adjusted position of the umbrella.
Figure 6:
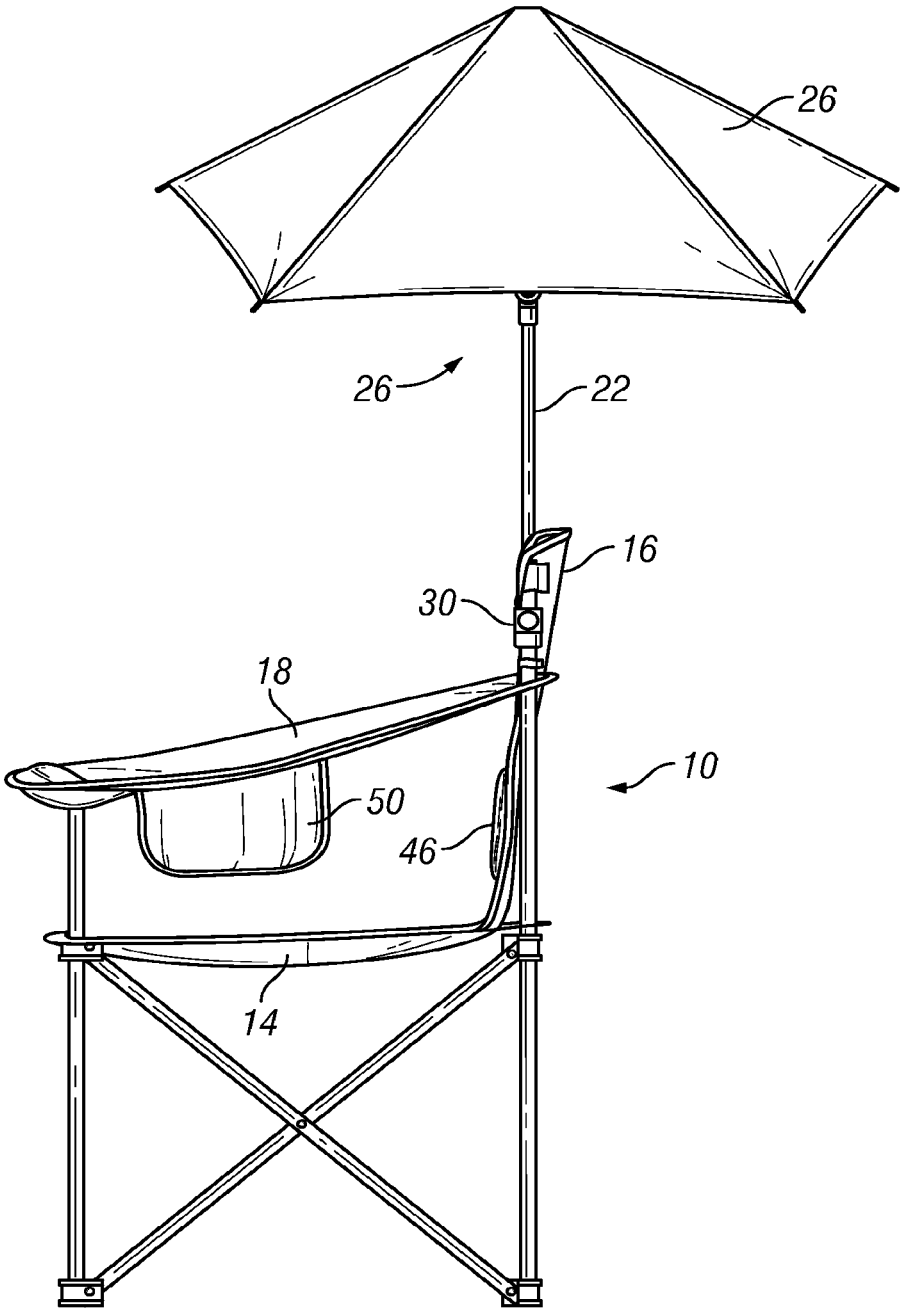
FIG. 6 is a rear elevation view of the canopy chair.

Preferably, the hinge 42 allows 360° rotation of the umbrella 20 relative to the chair 10. The push button hinge 42 allows the canopy 20 to move between a use position extending above the chair 10 and a storage position adjacent the frame 12. The hinges 40 and 42 lock in position at incremental angles. When the button of the hinge is depressed, the hinge is unlocked to allow rotational movement about the button axis. When the button is released, the hinge locks in the selected angular orientation. Thus, the umbrella can be pivoted about one or both hinges 40, 42 to provide shade to the chair 10, depending on the sun angle relative to the chair. The post segments 36, 38 can be co-axially aligned, as shown in FIGS. 1-4, or may be disposed at various angles, as shown in one example of FIG. 5.

Figure 8:
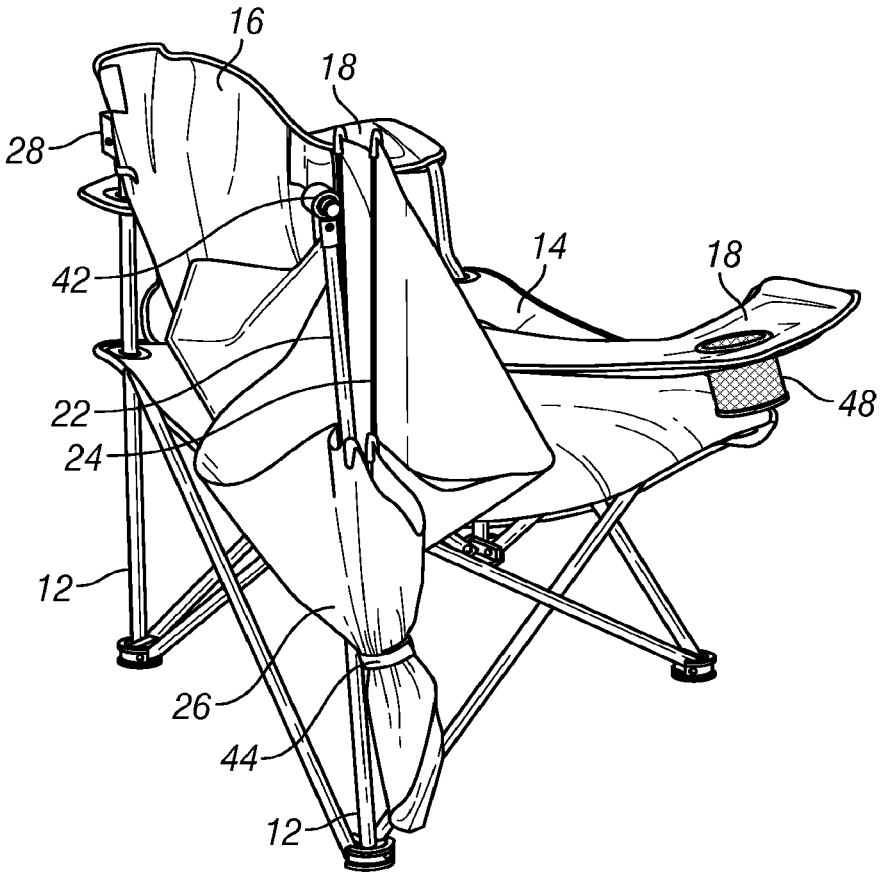
FIG. 8 is a perspective view of the chair with the umbrella folded down to a storage position adjacent the chair frame.
Figure 9:
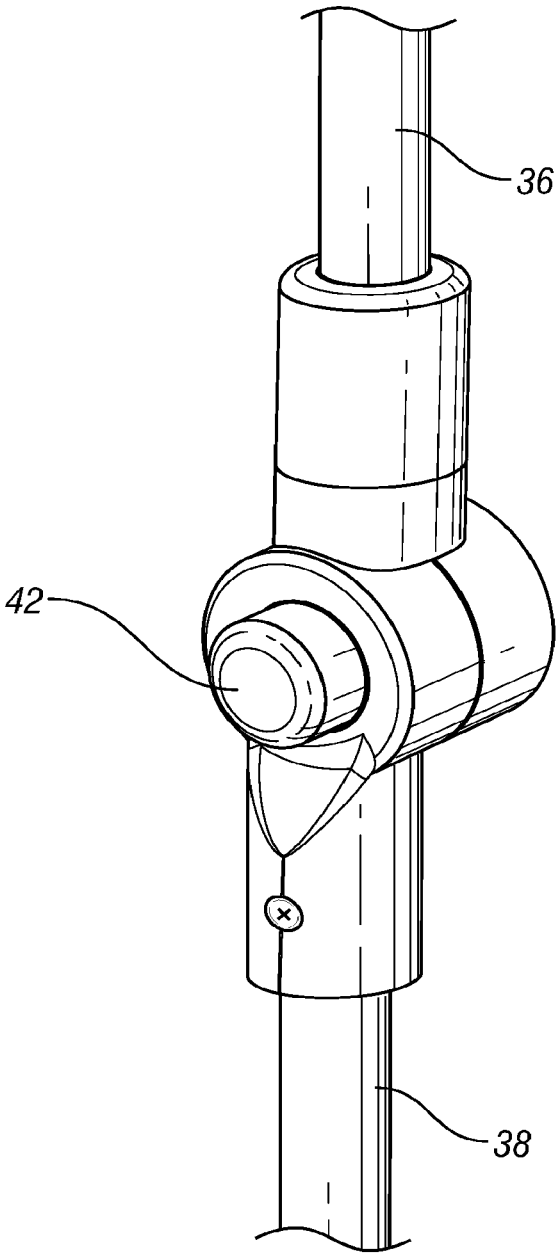
FIG. 9 is an enlarged, exploded view of the clip components of the chair and umbrella.
Figure 10:
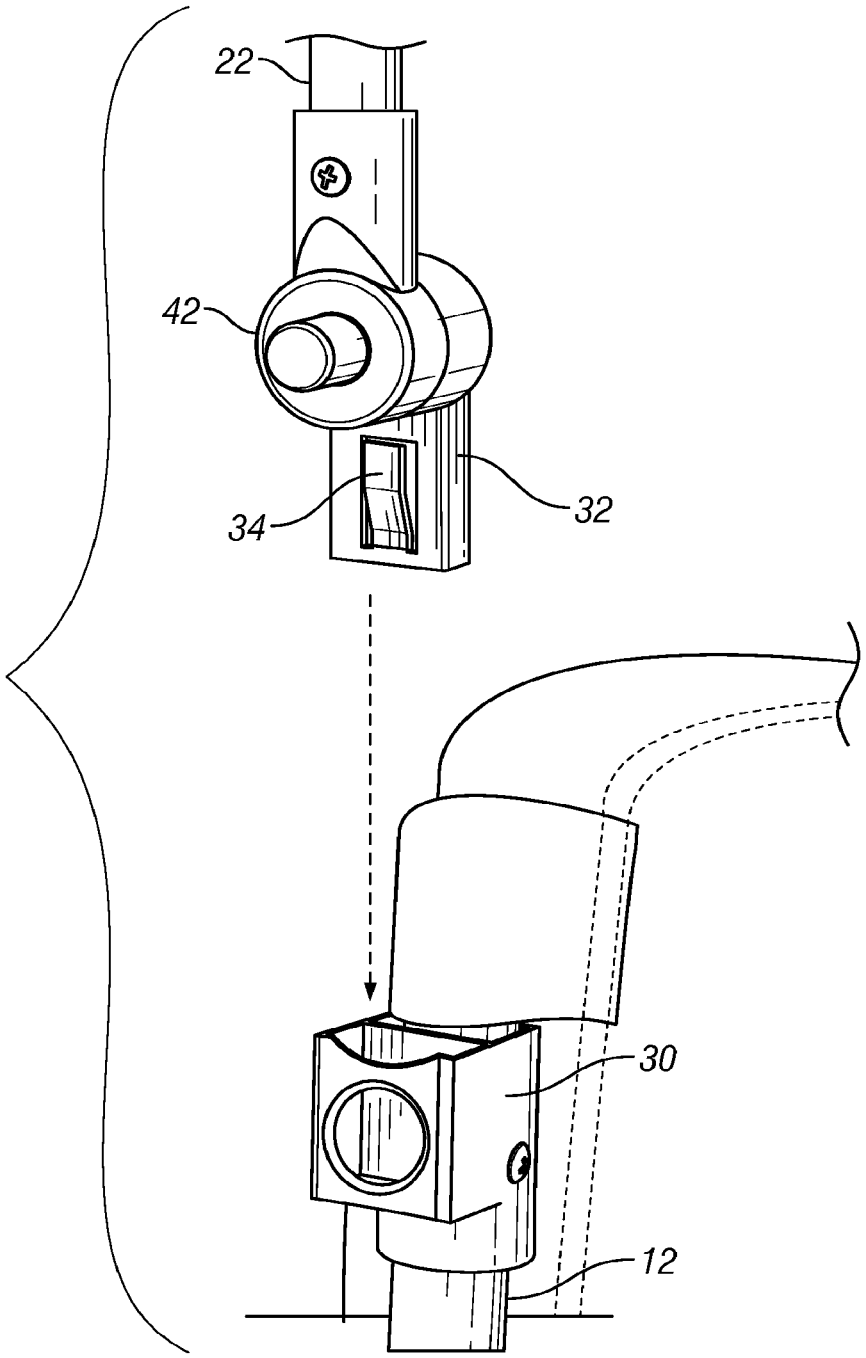
FIG. 10 is an enlarged view of one of the push button hinges of the canopy post.

A Velcro strap 44 may be provided to hold the collapsed umbrella body 26 in the storage position, as shown in FIG. 8. The Velcro strap 44, if long enough, may also extend around the frame 12 to secure the canopy 20 in the storage position. The storage position of the canopy 20 can be maintained when the chair 10 is folded open for use or folded down for storage and carrying in a sleeve bag (not shown).

The body 26 of the canopy or umbrella 20 is rotationally mounted on the upper end of the post 22 for 360° rotation in either direction about the axis of the upper post segment 36. Thus, rotation of the body 20 about the axis of the upper post segment 36, and the pivotal movement of the post segments 36, 38 about the horizontal axes of the push button hinges 40, 42 allows the canopy or umbrella 20 to be selectively positioned by persons sitting in the chair to provide the desired protection from the sun, wind and/or rain. The umbrella 20 can also be clipped to either side of the chair, depending on the sun angle, for the best protection.

Figure 7:
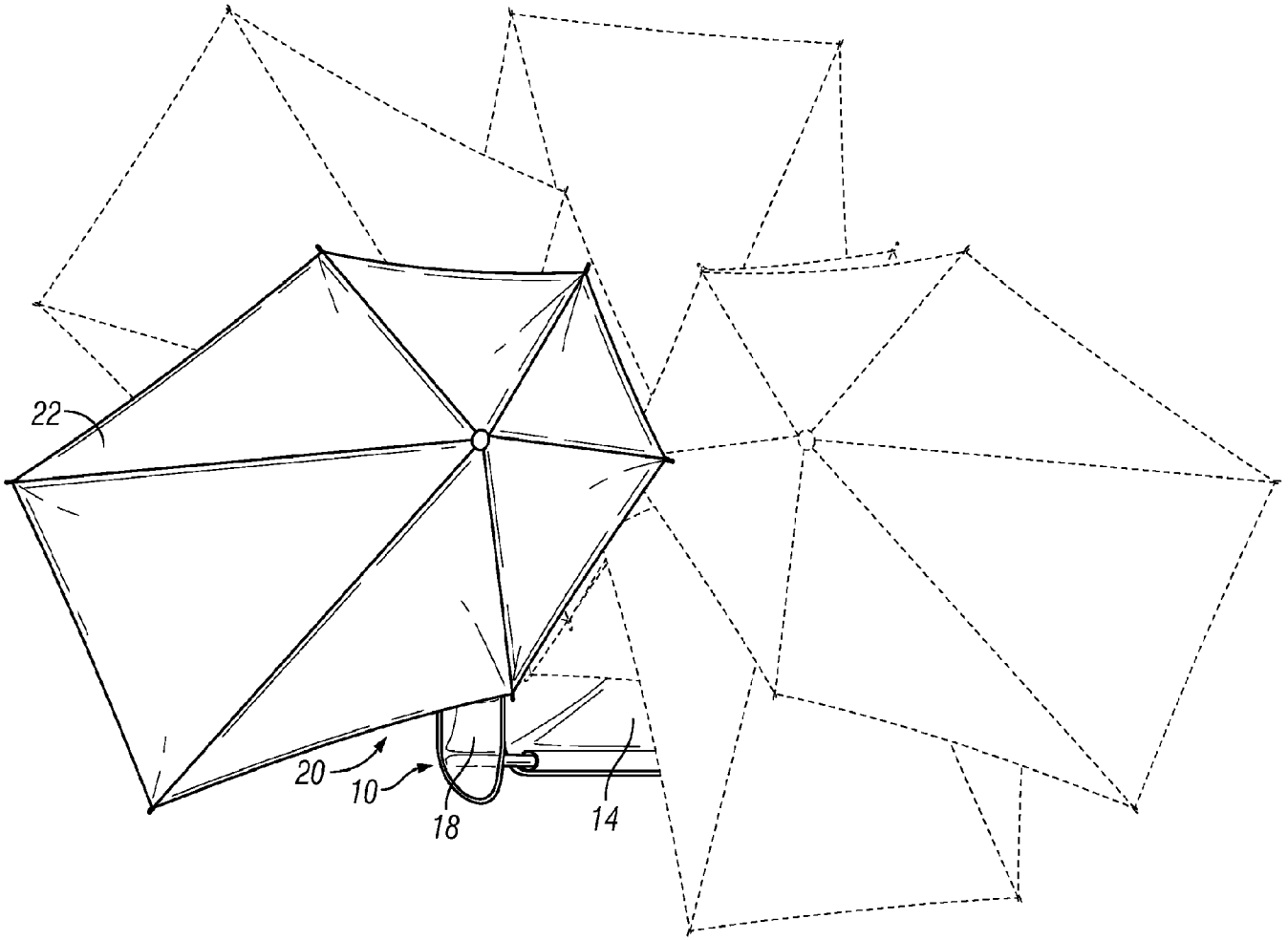
FIG. 7 is a top plan view of the canopy chair, showing the umbrella in alternative positions rotated about a substantially vertical axis.

The shape of the body 26 of the canopy or umbrella 20 may be non-symmetrical, with the post 22 being offset with respect to the center of the body 26. The spokes 24 do not have equal lengths, as in a conventional umbrella. For example, as best seen in FIG. 7, there are two short spokes, two long spokes and two intermediate spokes. This offset, non-symmetrical shape of the canopy or umbrella 20 allows the umbrella to be mounted to one side of the chair frame 12, while still providing shade or protection across the full width of the chair 10, as best shown in FIG. 7. The umbrella shape defines a long side, a short side, and opposite lateral sides, any of which may be positioned toward the front of the chair 10, to provide desired shade while also allowing a person sitting in the chair to view an activity or event without obstruction by the umbrella. Preferably, the underside of the body 26 has a coating or metallic layer to provide enhanced ultraviolet protection and heat resistance.

The chair 10 has additional unique features for comfort and convenience. Padding may be provided in the fabric of the seat 14, back rest 16, and arm rests 18. A lumbar support 46 is provided in the back rest 16 for added comfort. A beverage receptacle 48 may be provided in one or both of the arm rests 18. Storage pockets 50, 52 may be provided on one or more of the arm rests 18 and on the front of the seat 14. Preferably, the pockets 50, 52 include zippers 54 for opening and closing the pockets. One of the zippers 54 may also include a bottle cap opener on the zipper pull.

In use, when a person is finished sitting in the chair 10, the spokes or ribs 24 can be quickly and easily collapsed or retracted to fold down the umbrella body 26 by pulling downward on a collar slidably mounted on the post 22 and to which the inner ends of the spokes are attached. Then, the post segments 36, 38 are straightened, if angularly oriented, by depressing push button hinge 40. Then, the push button hinge 42 can be actuated so that the post 22 can be folded rearwardly and downwardly to a position adjacent the rear corner of the frame 12. The frame 12 can then be folded to a fully collapsed position and inserted into a carrying bag or case, without detaching the canopy 20. The left and right side clips, the button hinges, and the rotational body of the umbrella allow for positioning options of the umbrella relative to the chair.

The invention has been shown and described above with the preferred embodiments, and it is understood that many modifications, substitutions, and additions may be made which are within the intended spirit and scope of the invention. For example, the post 22 can be detachably connected to the frame 12 with a connector or mounting means other than the clip 28, and different hinges may be used for pivoting the post 22 relative to the frame 12 or chair 10. The post 22 may also be a single piece or multiple pieces, or have a telescoping construction. The structure of the chair may also vary from that shown in the drawings.

The invention claimed is:

1. A folding chair and umbrella combination, comprising:
- a folding chair including:
  - a folding chair frame having a first side and a second side;
  - a seat on the folding frame;
  - a first frame fitting on the first side of the frame;
  - a second frame fitting on the second side of the frame; and
- an umbrella including:
  - a single pole and a collapsible canopy attached to the single pole;
  - a pole fitting on a lower end of the single pole engageable with both the first frame fitting and the second frame fitting, to allow the umbrella to be attached on either side of the folding chair frame.

2. The folding chair and umbrella combination of claim 1 wherein the canopy is rotatably attached to the pole and includes spokes of non-equal length.

3. The folding chair and umbrella combination of claim 1 with the pole comprising a first segment attached to a second segment by a hinge lockable when the first segment is at one or more selected angles relative to the second segment.

4. The folding chair and umbrella combination of claim 3 with the hinge comprising a locking push button hinge.

5. The folding chair and umbrella combination of claim 1 with the canopy attached to the pole via a rotation joint to allow the canopy to rotate relative to the chair frame.

6. A folding chair and umbrella combination, comprising:
- a chair including:
  - a folding chair frame left and right frame members;
  - a seat and a back support attached to the folding chair frame;
  - a left frame fitting in a permanent fixed position on the left frame member;
  - a right frame fitting in a permanently fixed position on the right frame member; and
- an umbrella including:
  - a single pole and a canopy attached to the pole;
  - a pole fitting on a lower end of the pole, with the pole fitting adapted to releasably attach to the left frame fitting and to the right frame fitting.

7. The folding chair of claim 6 wherein the canopy is attached to the pole via a rotation joint, and with the canopy having spokes of non-equal length.

8. The folding chair of claim 6 with the pole comprising a first segment attached to a second segment by a hinge lockable when the first segment is at one or more selected angles relative to the second segment.

9. The folding chair of claim 8 with the hinge comprising a locking push button hinge.

* * * * *